US006448898B1

(12) United States Patent
Kasik

(10) Patent No.: US 6,448,898 B1
(45) Date of Patent: Sep. 10, 2002

(54) SYSTEM FOR AUDITING REFUSE COLLECTION

(75) Inventor: John P. Kasik, Dallas, TX (US)

(73) Assignee: Cardinal Automation, Inc., Dallas, TX (US)

( * ) Notice: Subject to any disclaimer, the term of this patent is extended or adjusted under 35 U.S.C. 154(b) by 0 days.

(21) Appl. No.: 09/965,964

(22) Filed: Sep. 28, 2001

Related U.S. Application Data

(63) Continuation-in-part of application No. 09/465,162, filed on Dec. 16, 1999, now Pat. No. 6,295,946.

(51) Int. Cl.[7] ..... G08B 21/00

(52) U.S. Cl. ..... 340/686.1; 340/572.8; 414/408; 177/137; 232/35; 235/435

(58) Field of Search ..... 340/686.1, 572.8, 340/539; 414/408; 177/139, 6; 232/35; 235/435; 116/303

(56) References Cited

U.S. PATENT DOCUMENTS

| | | | | | |
|---|---|---|---|---|---|
| 795,239 | A | | 7/1905 | Smith | 232/35 |
| 926,613 | A | | 6/1909 | Sheets et al. | 232/28 |
| 1,173,134 | A | | 2/1916 | Whitney | 220/212 |
| 1,512,337 | A | * | 10/1924 | Jackson | 232/35 |
| 2,444,679 | A | * | 7/1948 | Shaukis | 232/35 |
| 3,137,408 | A | | 6/1964 | Taylor | 220/326 |
| 4,241,846 | A | | 12/1980 | Murphy | 220/318 |
| 4,363,439 | A | * | 12/1982 | Manian | 232/35 |
| 4,645,018 | A | * | 2/1987 | Garbade et al. | 177/6 |
| 4,655,390 | A | | 4/1987 | Martin | 232/35 |
| 4,836,394 | A | | 6/1989 | Glomski | 220/811 |
| 4,854,406 | A | | 8/1989 | Appleton et al. | 177/139 |
| 4,860,267 | A | | 8/1989 | Herrington et al. | 363/10 |
| 5,007,786 | A | | 4/1991 | Bingman | 414/409 |
| 5,071,307 | A | | 12/1991 | Carson | 414/403 |
| 5,098,250 | A | | 3/1992 | Carson | 414/411 |
| 5,171,119 | A | | 12/1992 | Carson | 414/408 |
| 5,222,853 | A | * | 6/1993 | Carson | 414/408 |
| 5,230,393 | A | * | 7/1993 | Mezey | 177/139 |
| 5,251,761 | A | | 10/1993 | Hansen et al. | 209/3.3 |
| 5,465,841 | A | | 11/1995 | Wilson et al. | 206/366 |
| 5,491,483 | A | * | 2/1996 | D'Hont | 342/42 |
| 5,524,818 | A | | 6/1996 | Patry et al. | 232/35 |
| 5,560,540 | A | | 10/1996 | Amendola | 232/35 |
| 5,565,846 | A | * | 10/1996 | Geiszler et al. | 340/572.2 |
| 5,595,317 | A | | 1/1997 | Hodge | 220/831 |
| 5,634,589 | A | | 6/1997 | Greene | 232/35 |
| 5,762,461 | A | * | 6/1998 | Frohlingsdorf | 414/408 |
| 5,861,805 | A | * | 1/1999 | Reeves | 340/539 |
| 6,092,690 | A | | 7/2000 | Bitowft et al. | 220/831 |
| 6,172,609 | B1 | * | 1/2002 | Lu et al. | 340/572.4 |
| 6,191,691 | B1 | * | 2/2002 | Serrault | 340/572.8 |

* cited by examiner

*Primary Examiner*—Benjamin C. Lee
(74) *Attorney, Agent, or Firm*—Gary M. Cohen

(57) ABSTRACT

A signaling device is mated with a conventional container to develop a change in state for indicating that the container has been accessed. The change in state can be developed manually, or automatically when the cover of the container is opened, to signal that the container has been accessed, and can be automatically returned to the initial state as part of the procedures used to empty the container. The signaling device is used in combination with a system for auditing a refuse collection process so that subscribers to the service can be charged for service according to usage. This then motivates the subscribers to call for collections of their refuse only from containers that are substantially full, or to compensate the refuse collection service for additional container pick-ups.

57 Claims, 10 Drawing Sheets

SYSTEM FOR AUDITING REFUSE COLLECTION

RELATED CASE

This is a continuation-in-part of prior U.S. patent application Ser. No. 09/465,162, filed Dec. 16, 1999, U.S. Pat. No. 6,295,946.

BACKGROUND OF THE INVENTION

The present invention relates primarily to the field of refuse collection, and more particularly, to a system which can operate responsive to a device for signaling when a container, such as a refuse container, is ready to be emptied, and which can then audit the requested refuse pick-up. Although the following discussion is given in the context of refuse collection, it will be appreciated that the improvements which follow can benefit other industries which use containers for any of a variety of diverse purposes.

In conjunction with the collection of refuse, common practice is to station containers at each of a plurality of sites so that customers of the collection service can deposit refuse in their respective containers for subsequent collection, usually according to a pre-established schedule. The collection service then takes appropriate steps, according to the pre-established schedule, to empty the containers of its customers and to remove the contents for disposal. Some collection services charge a flat fee for the services provided, while others charge according to the number of containers that are emptied.

A common practice for emptying the containers of their contents is to employ a service vehicle which includes a hopper for receiving the contents of the containers, and a lifting mechanism for engaging each of the several containers and for lifting the engaged container to the hopper. In the course of lifting the container to the hopper, steps are taken to invert the container so that its contents fall into the hopper under the influence of gravity. This is often facilitated by providing the lifting mechanism and the container with cooperating structures which enable the operator to perform the desired operations remotely, from the service vehicle.

Such a procedure can be quite efficient since the entire operation can be performed remotely, by a single operator driving the service vehicle. In the course of such operations, however, it was not uncommon for the operator to perform such scheduled operations on empty containers. This tended to limit the overall efficiency of the operation, in turn contributing to unnecessary costs (e.g., labor costs, fuel costs, etc.).

SUMMARY OF THE INVENTION

To correct this problem, U.S. patent application No. 09/465,162, filed Dec. 16, 1999, and entitled "Signaling Device for Use with a Container" discloses a signaling device which can be mated with an otherwise conventional container to develop a change in state which is indicative of access to the container.

In conjunction with a refuse container having a body and a cover connected to the body of the container by a hinge, the signaling device preferably takes the form of a flag, one end of which is coupled with the hinge of the container. The hinged connection allows the flag to move between a lowered position in which the flag lies over the cover of the container, and a raised position in which the flag extends upwardly from the container.

Resulting from interaction between the flag and the cover, the flag is automatically moved from the lowered position to the raised position as the cover is opened, signaling that the container has been accessed. The flag is further automatically returned from the raised position to the lowered position when the container is emptied. For cases where the container is emptied by lifting the container to the hopper of a service vehicle, inversion of the container operates to return the flag to the lowered position after the container has been emptied.

This then allows the operator to empty only those containers having a signaling device which indicates that the particular container has been accessed, requiring the operator to empty only those containers likely to have contents and allowing the operator to bypass those containers showing no sign of having been accessed since the container was last emptied. This, in turn, allows the operator to proceed at a more rapid, productive and efficient overall pace.

As a result, the signaling device operates to prevent those containers which have not been accessed from being subjected to a refuse emptying operation, significantly improving the overall efficiency of the refuse collection process. In practice, however, it was found that further improvements to the overall efficiency of the refuse collection process would be possible if even partially filled containers were bypassed, leaving only those containers that are full, or substantially full, to be emptied.

In accordance with the present invention, this is achieved by combining the foregoing signaling device with a system for auditing the refuse collection process. To this end, customers are charged for service according to the number of times that their refuse containers are accessed. The customers subscribing to the service (hereafter, the "subscribers") are then motivated to call for collections of their refuse only from containers that are substantially full, or the refuse collection service is compensated for additional container pick-ups.

Desired collections are called for by moving the signaling device to a pre-established position (e.g., a raised position) which indicates that the container is ready to be emptied. The operator of the service vehicle would then take steps to access and empty the subscriber's container. In the course of accessing the container, steps are taken, preferably automatically, to identify the subscriber (e.g., by address) and to store data corresponding to each transaction. The stored data is then collected and used to charge each subscriber according to the collection which has been requested. In this way, the subscribers are motivated to call for pick-ups only when their refuse containers are substantially full, still further improving the overall efficiency of the refuse collection process, or the refuse collection service is compensated for additional container pick-ups.

For further detail regarding preferred implementations of the present invention, reference is made to the detailed description which is provided below, taken in conjunction with the following illustrations.

DETAILED DESCRIPTION OF THE INVENTION

Figure 1:
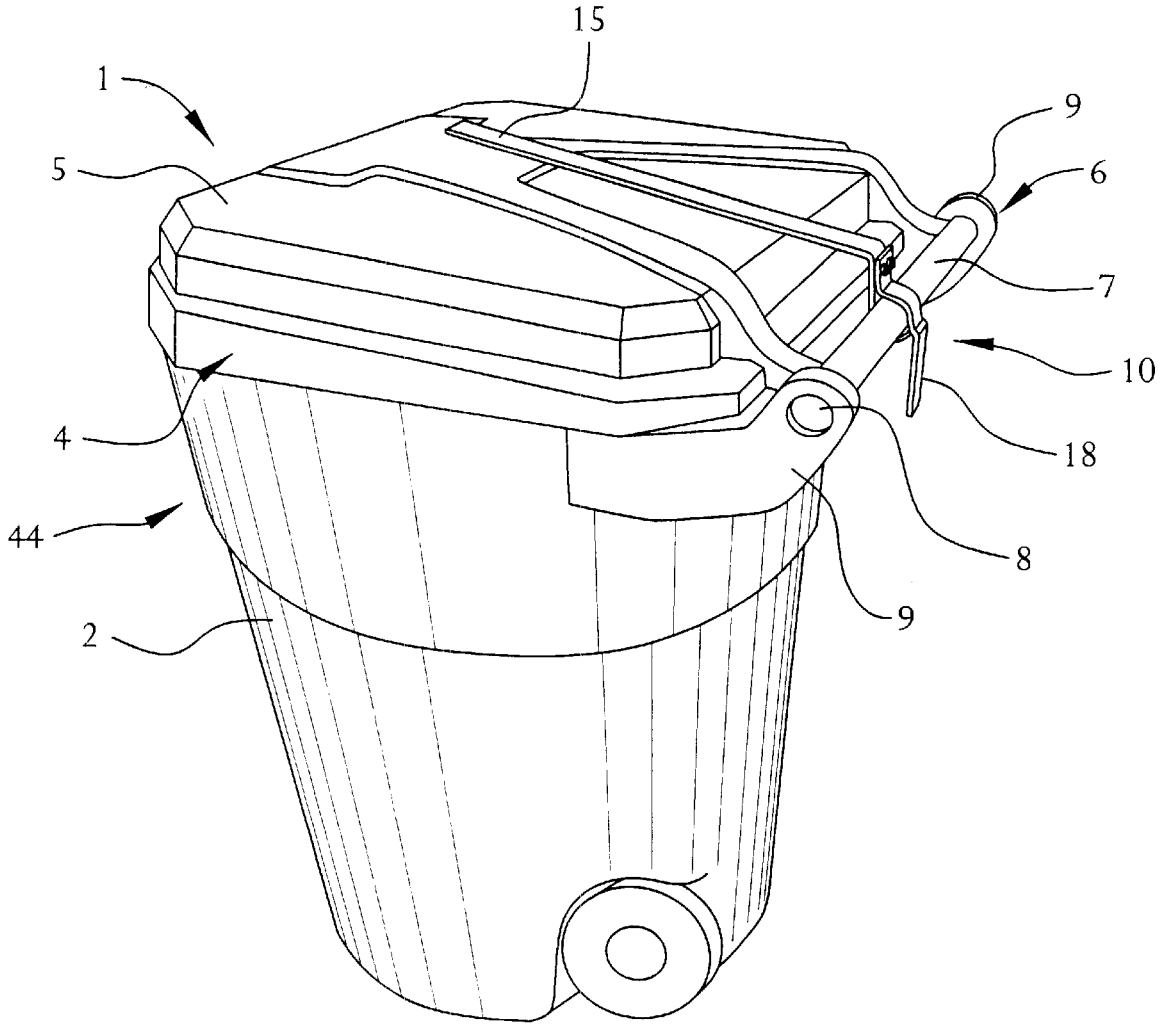
FIG. 1 is an isometric view of a container provided with a signaling assembly produced in accordance with the present invention, with the cover of the container in a closed position.

FIG. 1 shows a container 1 which has been fitted with a signaling assembly 10 produced in accordance with the present invention. It will be recognized that the container 1 selected for illustration in the drawings is of a type commonly used for containing refuse which is to be collected by a servicing agency. It is to be understood that the container 1 has been selected only for purposes of illustration, and that the improvements of the present invention may similarly be used with any of a number of different refuse container designs, as well as any of a variety of container designs which are useful for purposes other than refuse collection.

The container 1 is itself entirely conventional, corresponding to any of a variety of known container designs, and generally includes a body 2 for receiving contents through an opening 3 (see FIG. 3) defined in upper portions 4 of the container 1, and a cover 5 for enclosing the opening 3 so that the contents of the container are appropriately secured within the container 1. The cover 5 is connected to the body 2 of the container 1 by a hinged connection, at 6, which preferably incorporates the handle 7 which is conventionally provided for use in maneuvering the container 1. Ends 8 of the handle 7 are advantageously engaged by a pair of journals 9 extending from the body 2 of the container 1 so that the cover 5 can be rotated about the hinged connection 6 relative to the body 2 of the container 1.

In accordance with the present invention, the container 1 is fitted with a signaling assembly 10 which is operatively coupled with the handle 7 of the hinged connection 6. To this end, and referring to FIG. 2, the signaling assembly 10 is preferably formed from a pair of band sections 11, 12, which are joined to engage the handle 7. The band section 11 includes a curved segment 13 having a radius for cooperating with the handle 7, a mounting bracket 14 which extends from the curved segment 13, and a flag 15 which extends from the mounting bracket 14. The band section 12 similarly includes a curved segment 16 having a radius which corresponds to the radius of the curved segment 13. The curved segment 16 further includes a mounting bracket 17 at one end, for cooperating with the mounting bracket 14 of the band section 11, and a stop 18 at the other end, for interacting with the body 2 of the container 1 as will be further described below.

Figure 2:
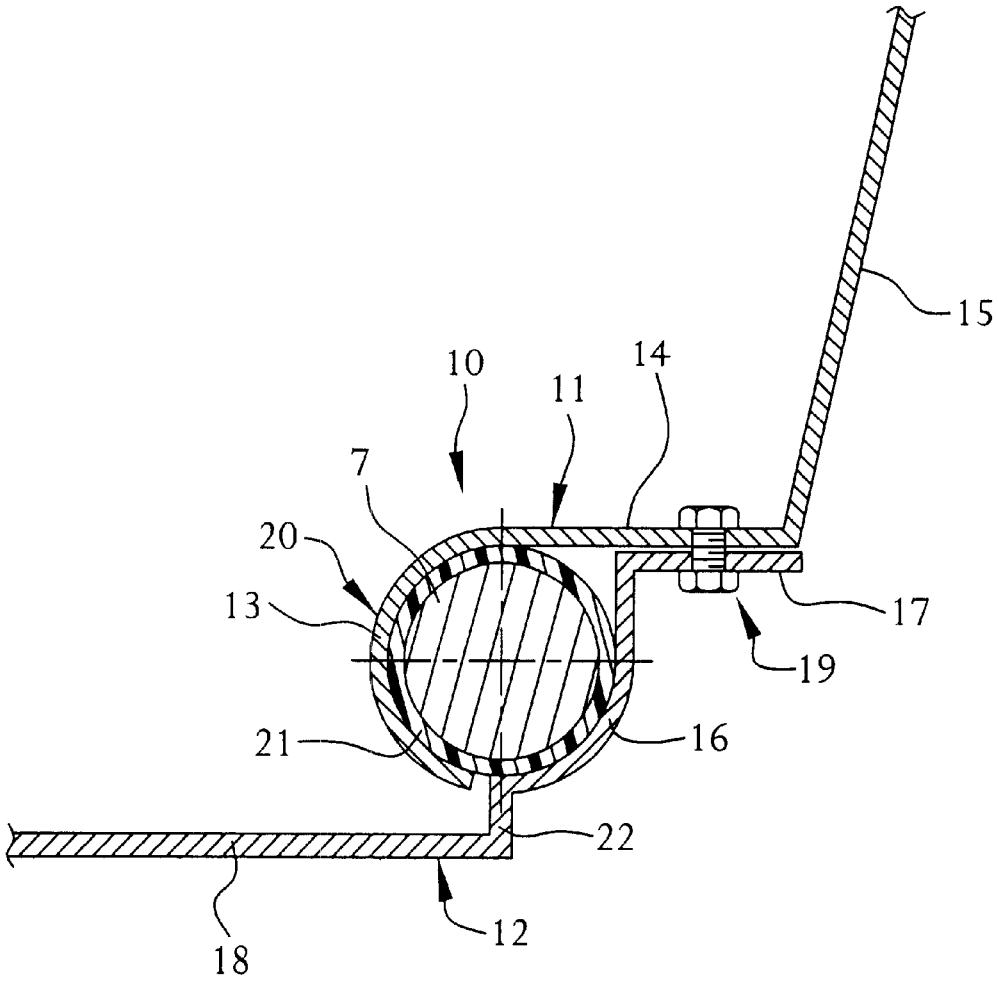
FIG. 2 is a cross-sectional view of the signaling assembly of FIG. 1, coupled with the hinge of the container which joins the cover to the body.

The band section 11 is positioned to oppose the band section 12, so that the curved segment 13 and the curved segment 16 can cooperate to surround and engage the handle 7. Suitable attachment hardware 19 (e.g., the nut and bolt shown) is then used to connect the mounting bracket 14 of the band section 11 with the mounting bracket 17 of the band section 12, forming an attachment assembly 20 which surrounds and engages the handle 7 of the hinged connection 6. Resulting from such assembly, the flag 15 is caused to project outwardly from one end of the attachment assembly 20 and the stop 18 is caused to project outwardly from the opposite end of the attachment assembly 20, as is best shown in FIG. 2.

The radius for the curved segments 13, 16 is preferably selected so that the joined structures will slidingly engage the handle 7. A grommet 21 can be positioned between the handle 7 and the joined curved segments 13, 16, if desired, to protect the handle 7. If used, the grommet 21 is preferably formed of a resilient rubber or plastic material. However, use of the grommet 21 is presently considered less preferred since it can introduce a limited degree of resistance between the signaling assembly 10 and the handle 7.

Both the flag 15 and the stop 18 will have a size and a configuration which will vary depending upon the size and the configuration of the container with which the signaling assembly 10 is to be mated. For the container 1, and as an example, the flag 15 includes an offset (the mounting bracket 14) which tangentially extends from the center of the handle 7 for about 2.5 inches, and projects at an angle (an obtuse angle, e.g., 105°) from the mounting bracket 14 for a length of about 20.0 inches. The stop 18 includes an offset 22 which radially projects from the handle 7 for about 0.5 inches, and projects at a right angle from the offset 22 for a length of about 4.25 inches. Such dimensions are preferred to permit the signaling assembly 10 to effectively interact with the existing structures of the container 1 as will be discussed more fully below. For this reason, the foregoing parameters should be considered as illustrations only, with the understanding that such parameters may be freely varied to cooperate with the particular container with which the signaling assembly 10 is to be used.

Operation of the foregoing structures will now be described with reference to FIGS. 1 through 5. Generally speaking, the container 1 will be stationed at a given location for a particular subscriber to the refuse collection service. The cover 5 will be positioned over the container 1 to maintain deposited items within the container 1.

Figure 3:
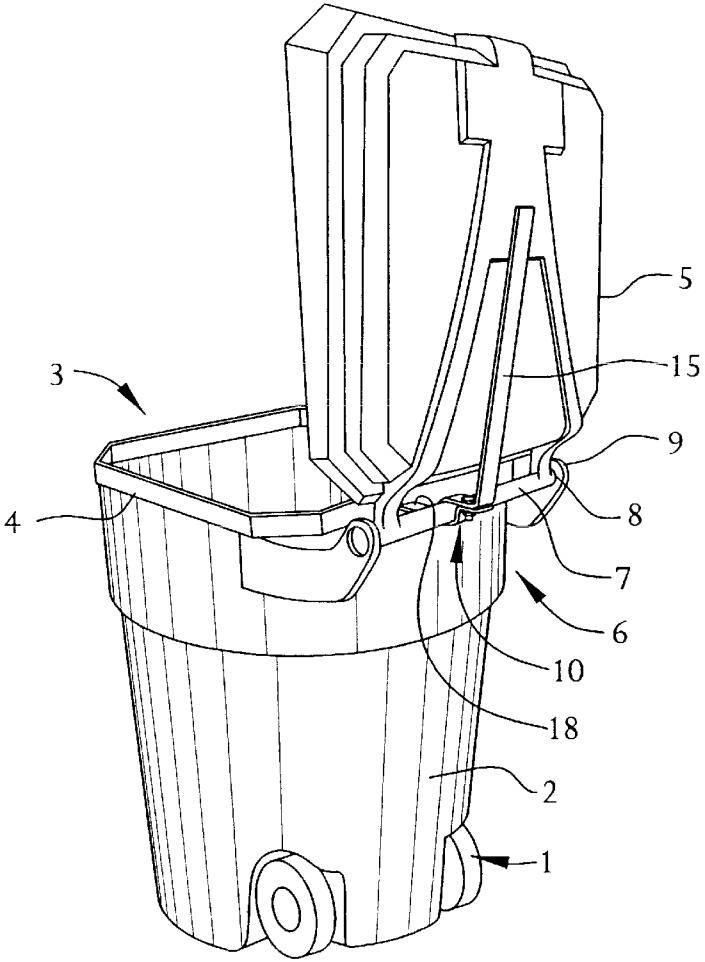
FIG. 3 is an isometric view of the container of FIG. 1, with the cover of the container in an opened position.

In accordance with the present invention, the flag 15 of the signaling assembly 10 will initially assume the lowered positioned shown in FIG. 1, lying over the cover 5 of the container 1. To deposit refuse in the container 1, the usual steps will be taken to raise the cover 5, as shown in FIG. 3. As the cover 5 is lifted, the flag 15 of the signaling assembly 10 will be engaged by the surface of the cover 5, automatically moving the flag 15 to its raised position. Contact between the stop 18 and the body 2 of the container 1 operates to limit movement of the flag 15 so that the raised flag 15 will maintain a generally vertical orientation.

Figure 4:
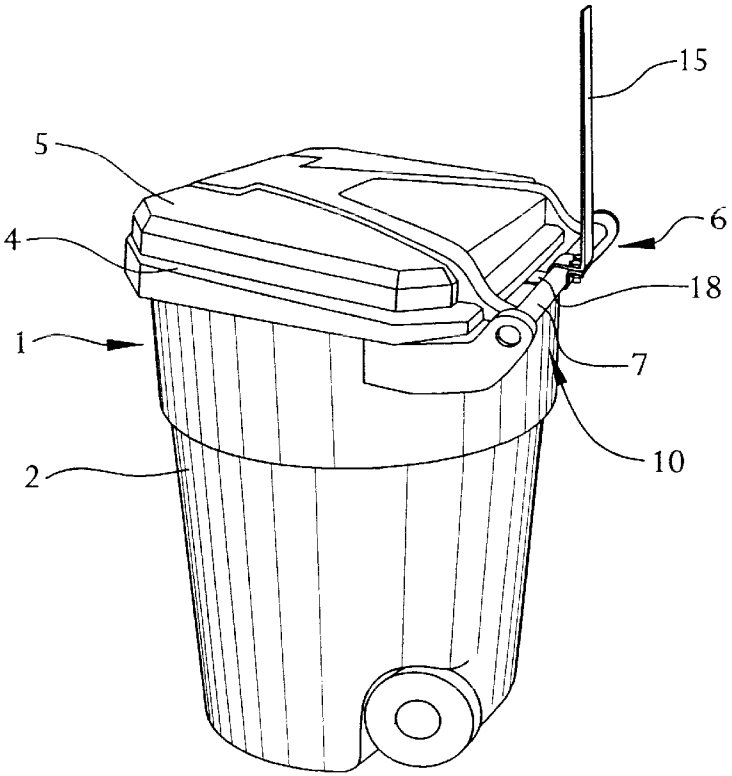
FIG. 4 is an isometric view of the container of FIG. 1, with the cover of the container returned to the closed position after having been opened.

Resulting from the configuration of the signaling assembly 10, the weight of the flag 15 will cause the signaling assembly 10 to remain in the raised position after the cover 5 has been closed. The flag 15 will be retained in this raised (i.e., generally vertical) orientation responsive to contact between the stop 18 and the body 2 of the container 1. As a result, and as is best shown in FIG. 4, the flag 15 will remain vertical when the cover 5 is replaced over the container 1, providing a clear and positive indication that the container 1 has been accessed. This indication is given automatically, resulting from normal use of the container 1, and no positive intervention is required to raise the flag 15 and notify the refuse collection service that the container 1 has been accessed.

As a result, unless the raised flag 15 is lowered by the subscriber, a refuse collection will be called for, ensuring that refuse is not in error left uncollected. However, in cases where the container 1 is not yet reasonably full, and a pick-up is not yet desired, the flag 15 can be returned to its lowered position, avoiding a pick-up which is not yet desired.

The refuse collection service will provide (generally according to a prearranged schedule) a suitable service vehicle for emptying the various containers of its subscribers, and the operator of the service vehicle will follow a prearranged route for accessing and emptying the subscribers' containers. However, in accordance with the present invention, the operator is provided with the ability to visually identify the containers which have been accessed since the particular route was last serviced by visually identifying those containers having a raised flag 15. In this way, only those containers requiring service need be operated upon. Any containers having a flag 15 which remains in the lowered position can be bypassed, saving both time and labor costs.

Figure 5A:
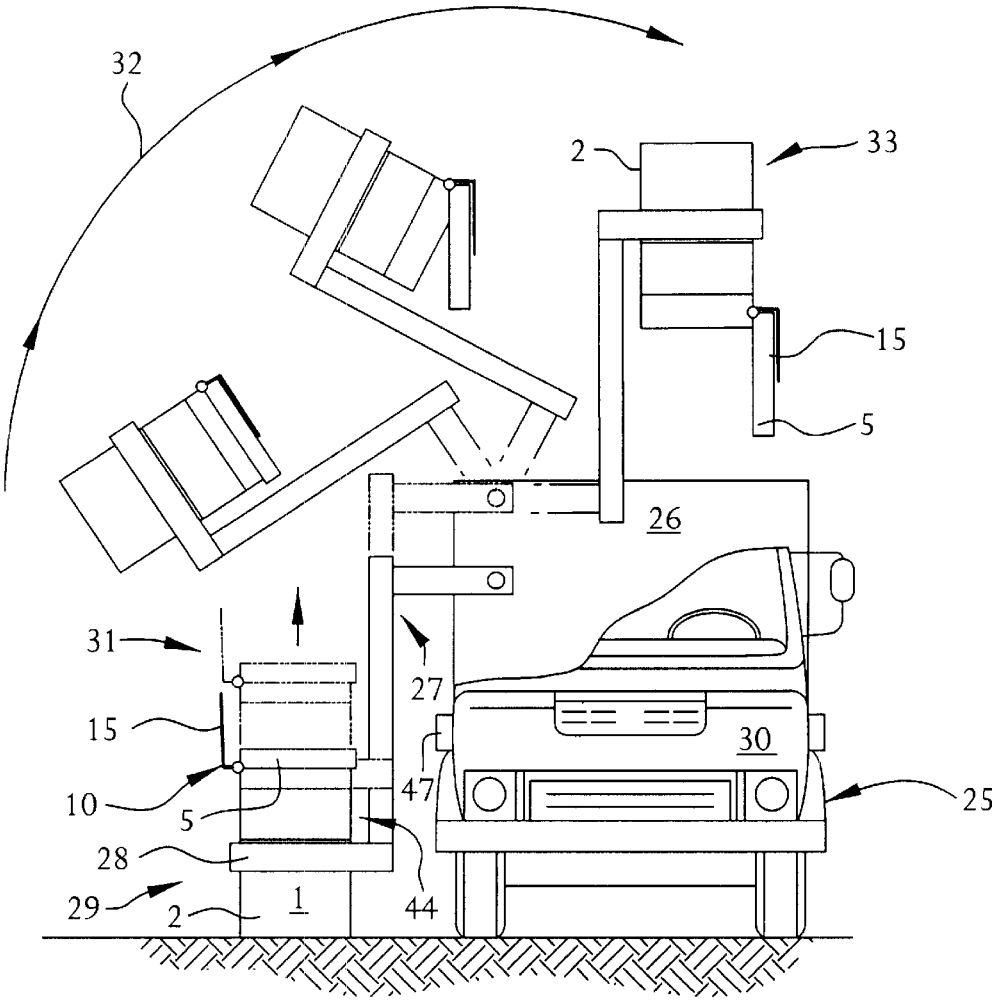
FIGS. 5A, 5B, 6A and 6B are sequential, schematic views showing operation of the signaling assembly of the present invention while the container is being emptied by a service vehicle.

FIG. 5A schematically illustrates the sequence of steps that will ordinarily be performed to empty a container 1 having a raised flag 15. To this end, let it be assumed that the service vehicle is a truck 25 having a hopper 26 for receiving refuse, and a mechanism 27 for remotely engaging a container and for lifting the engaged container to the hopper 26 so that the contents of the container can be discharged into the hopper 26. Initially, the operator will position the truck 25 so that a pair of claws 28 associated with the lifting mechanism 27 can engage the container 1 to be emptied, as is schematically shown at 29. This is conventionally done by positioning the body 2 of the container 1 between the pair of claws 28 so that the claws 28 can be closed over the body 2 of the container 1.

The lifting mechanism 27 is then activated by the operator (remotely, from the cab 30 of the truck 25), to lift the engaged container 1 to the hopper 26. Initially, the container 1 is lifted to a raised position, shown at 31, to provide clearance between the container 1 and the surface on which it rests. The lifted container 1 is then caused to proceed along the path 32, until such time as the container 1 is brought to the position 33. In the position 33, the container 1 is inverted over the hopper 26, with the cover 5 extending downwardly under the influence of gravity. The flag 15 of the signaling assembly 10 will also extend downwardly, under the influence of gravity, keeping the flag 15 free and clear of the refuse which is being discharged from the container 1.

Figure 5B:
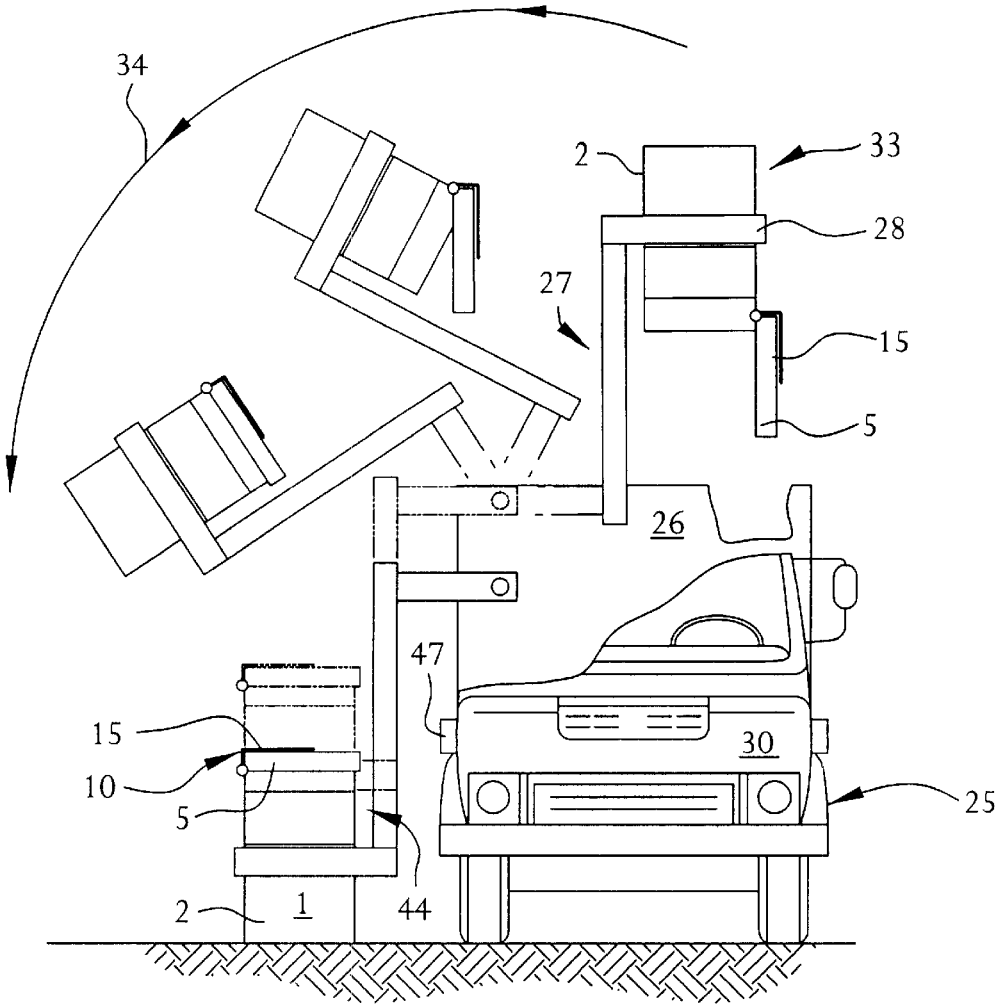

Referring now to FIG. 5B, the emptied container 1 is then returned to its initial position by the lifting mechanism 27. In the course of this transfer, along the path 34, the cover 5 of the container 1 is caused to return to a position enclosing the opening 3 of the container 1. The configuration of the signaling assembly 10 similarly causes the flag 15 to return to its initial, lowered position (with the flag 15 lying over the cover 5). Again, the return of the flag 15 to its initial position takes place automatically, without requiring any intervention by the operator, or the subscriber to the refuse collection service. The container 1 is then ready to receive future contents. If so, the flag 15 will again be raised, signaling for a future emptying procedure. If not, the flag 15 will remain lowered, signaling the operator that the container 1 can be bypassed. As a result, the operator need only take steps to empty those containers which require attention, saving both time and labor, and their associated costs.

As previously indicated, the signaling assembly 10 of the present invention can be used with any of a variety of different types of containers (including refuse containers and containers for use in applications other than the handling of refuse). As an example, FIGS. 6A and 6B show use of the signaling assembly 10 of the present invention with a container 35 of a type which is commonly used for handling commercial refuse.

Figure 6A:
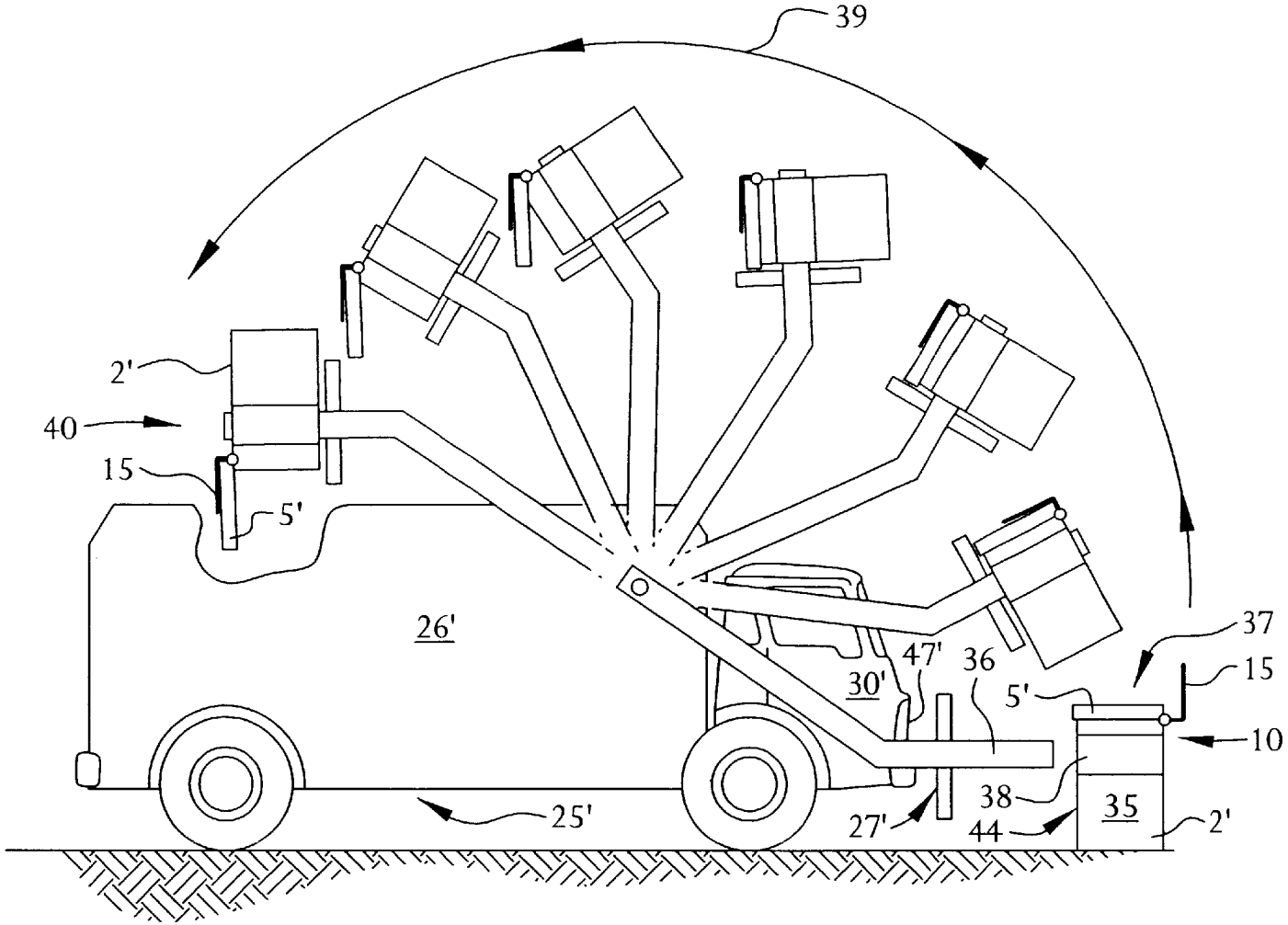

FIG. 6A schematically illustrates the sequence of steps that will ordinarily be performed to empty the container 35, again, only for those containers with a raised flag 15. In this case, the service vehicle is a truck 25' having a hopper 26' for receiving refuse, and a mechanism 27' for remotely engaging the container 35 and for lifting the engaged container 35 to the hopper 26' so that the contents of the container 35 can be discharged into the hopper 26'. To this end, the operator will initially position the truck 25' so that a pair of tines 36 associated with the lifting mechanism 27' can engage the container 35 to be emptied, as is schematically shown at 37. This is conventionally done by positioning the body 2' of the container 35 between the pair of tines 36 so that the tines 36 can engage a pair of brackets 38 associated with the sides of the container 35.

The lifting mechanism 27' is then activated by the operator (remotely, from the cab 30' of the truck 25'), to lift the engaged container 35 to the hopper 26'. This causes the container 35 to proceed along the path 39, until such time as the container 35 is brought to the position 40. In the position 40, the container 35 is again inverted over the hopper 26', with the cover 5' extending downwardly under the influence of gravity. The flag 15 of the signaling assembly 10 will also extend downwardly, under the influence of gravity, keeping the flag 15 free and clear of the refuse which is being discharged from the container 35.

Figure 6B:
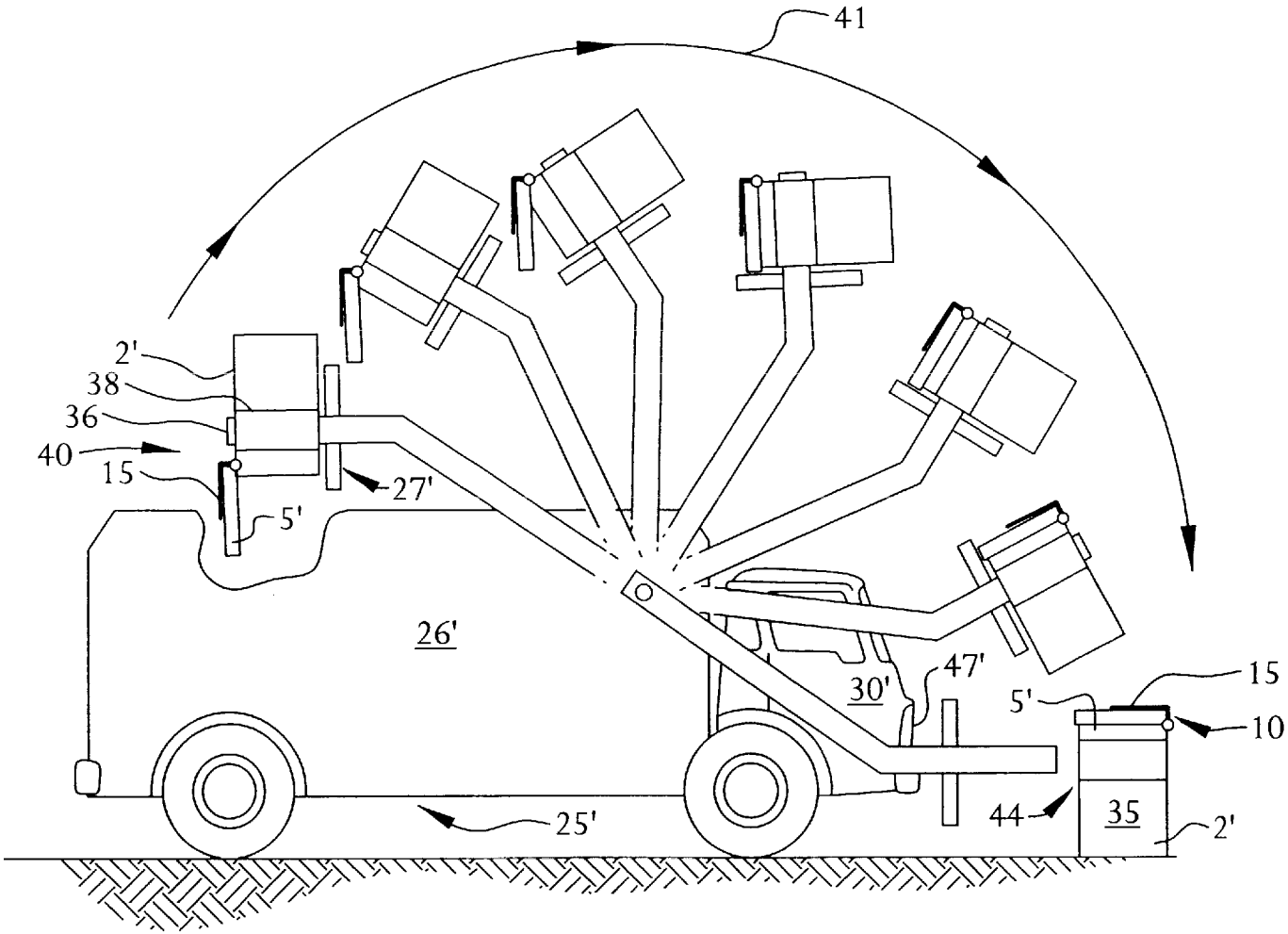

Referring now to FIG. 6B, the emptied container 35 is then returned to its initial position by the lifting mechanism 27'. In the course of this transfer, along the path 41, the cover 5' of the container 35 is caused to return to a position enclosing the opening of the container 35. The configuration of the signaling assembly 10 similarly causes the flag 15 to return to its initial, lowered position (with the flag 15 lying over the cover 5'). Return of the flag 15 to its initial position again takes place automatically, without requiring any intervention by the operator or the subscriber to the refuse collection service. The container 35 is then ready for further use.

The servicing operations illustrated in FIGS. 5A and 5B, and in FIGS. 6A and 6B, are described as fully automated procedures implemented by properly aligning the service vehicle with the container which is to be emptied. Equivalent results can be achieved for operations using manual labor, by manually moving (carrying or rolling) the container to be emptied into position for engagement with the lifting mechanisms 27, 27' of FIGS. 5A, 5B, 6A and 6B, or some other lifting mechanism.

Figure 7:
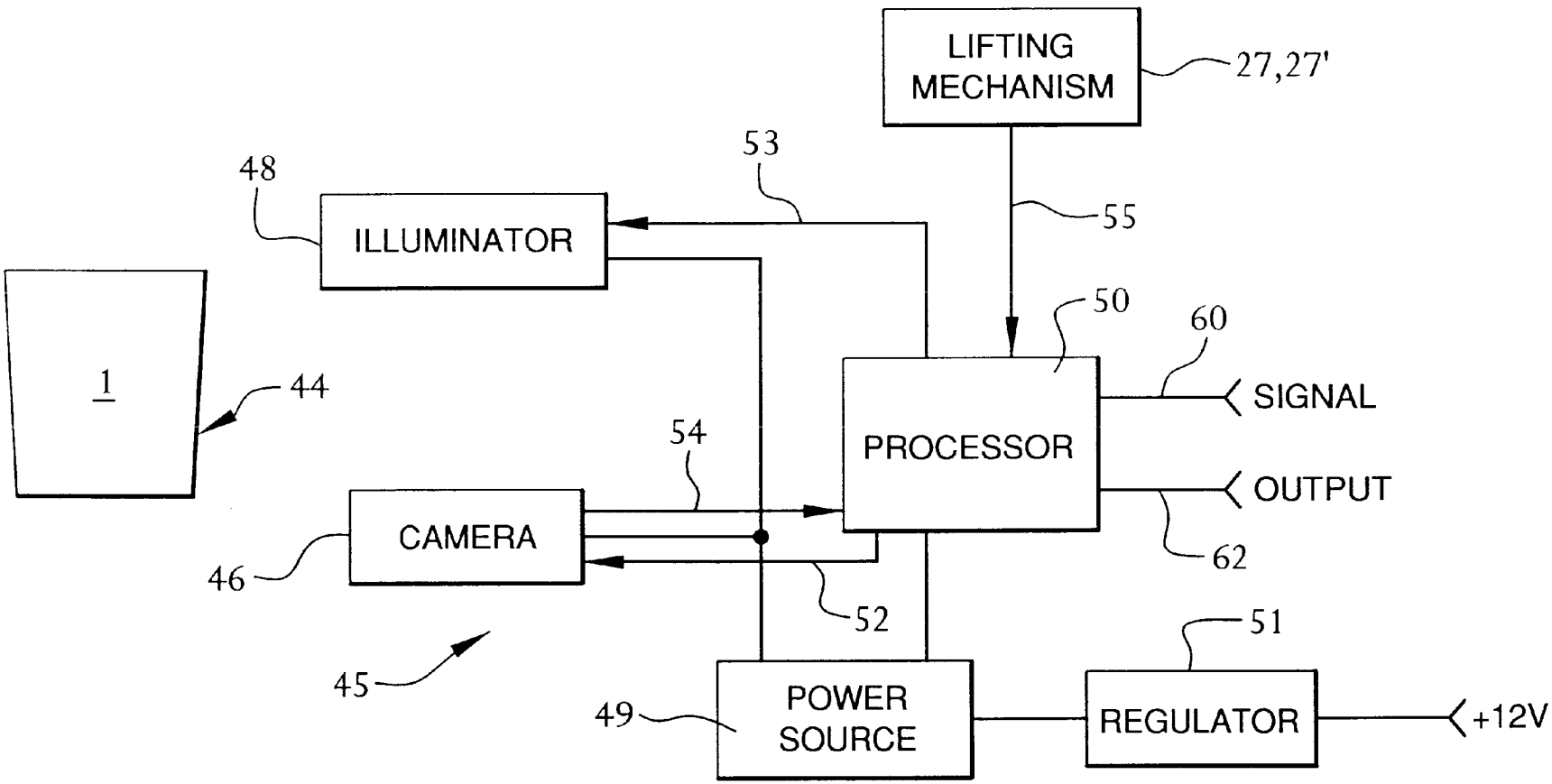
FIG. 7 is a block diagram of a system which can be mated with the service vehicles shown in FIGS. 5A, 5B, 6A and 6B to audit the collection process being performed by the service vehicle.

FIG. 7 shows a system 45 for auditing (i.e., tracking) operations associated with the refuse collection service. This can include operations such as those previously described, or other operations which may prove to be desirable in conjunction with a refuse collection service. Irrespective of the operations to be monitored, the primary parameters needed for purposes of auditing the refuse collection process will generally include identification of the subscriber and identification of the services provided. Identification of the subscriber can be accomplished by name, by address, or by other indicia unique to the subscriber (e.g., a customer number). Identification of the services provided can include an indication that a given container has been accessed, a count of the number of times that a subscriber's container has been accessed (e.g., on separate occasions or for subscribers with more than one container), the time and date of access, the weight of the contents removed, or a combination of such parameters. Other parameters may alternatively or additionally be monitored, if desired.

For purposes of identifying the subscriber, it is presently considered preferred to provide suitable markings on each of the containers to be accessed. This can include the marking of address information (or, less preferably, a name) on the body 2 of the container 1 (e.g., on the front, as indicated at 44), or on the cover 5. This can also include the placement of a coded label (e.g., a bar coded label) on the container 1 or on the signaling assembly 10 (e.g., on the flag 15), or the use of a signal transmitting device (e.g., an RF transmitter). The use of markings placed on the body of the container is presently preferred for reasons of robustness. Bar coded labels and the like are more prone to damage, which can compromise their ability to be read, and cannot be read by individuals, preventing both the subscribers and the operators of the service vehicles from being able to read the container-identifying information. Signal transmitting devices require batteries for their operations, which can compromise their ability to be detected, and which leads to the need for additional servicing.

Figure 8:
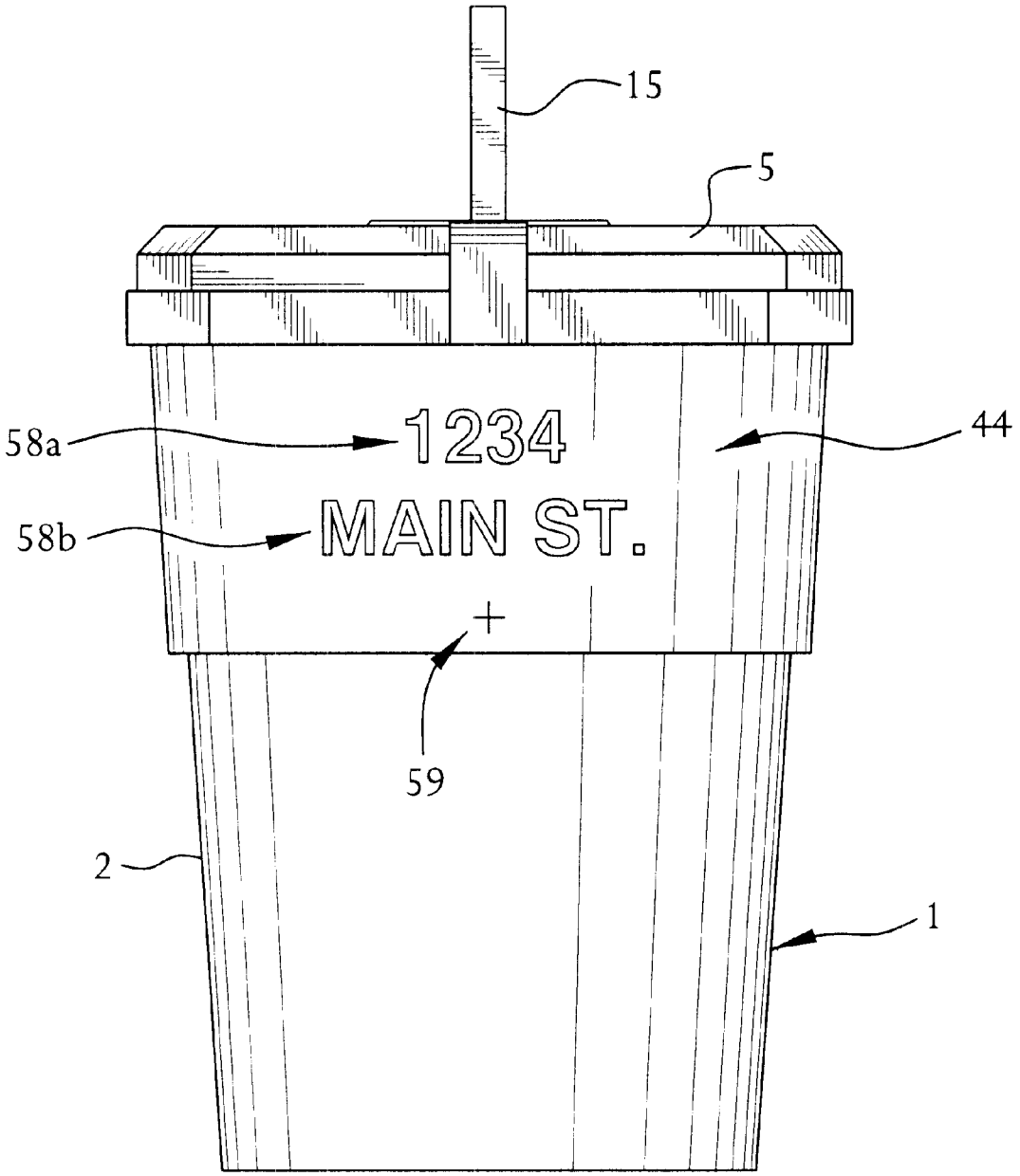
FIG. 8 is a front view of a container, also showing markings which can be used for identification purposes.

For purposes of this discussion, and as is presently preferred, the identifying markings provided are alphanumeric characters placed at the front 44 of the container 1 (or 35) which correspond to the subscriber's street address, as shown in FIG. 8. In such case, optical character recognition (OCR) techniques can then be used to read such markings for purposes of uniquely identifying the subscriber. A fiducial marking 59, such as the "+" shown in FIG. 8 or an equivalent marking, can additionally be provided to facilitate this process, if desired, by providing a known reference for registration of the OCR system which is used.

To this end, a suitable receptor (e.g., a CCD camera 46) is positioned to inspect the containers addressed by the service vehicle (e.g., the truck 25 shown in FIGS. 5A and 5B, or the truck 25' shown in FIGS. 6A and 6B). It is presently preferred to mount the camera 46 directly to the service vehicle at a position that allows the markings to be read after the service vehicle has been brought adjacent to the container 1, 35 (e.g., at 47 in FIGS. 5A and 5B, and at 47' in FIGS. 6A and 6B). It would also be possible to mount the camera 46 to the lifting mechanisms 27, 27' so the markings can be read as the container is addressed by the lifting mechanism. However, placement on the lifting mechanism is presently considered less preferred to minimize potentially damaging vibrations and issues of alignment.

A corresponding lighting device 48, which can be strcbed, switched or constant, is preferably coupled with the camera 46 to ensure that the markings to be read are effectively illuminated. Infrared lighting techniques can also be used, if desired. Alternatively, the markings can be applied to the containers using characters that minimize the need for direct lighting to permit the markings to be read. For example, this can be accomplished by applying matt-black characters to a matt-white background, by applying reflective characters to a non-reflective background (and vice versa), or by using a combination of retroreflective and non-retroreflective paints. The camera 46 and/or the lighting device 48 can be fitted with desired filters or lenses for purposes of improving accuracy or accommodating ambient conditions, if desired.

A single camera 46, and a corresponding lighting device 48, if used, can be coupled with the single lifting mechanism 27 (or 27') which is conventionally provided on most available service vehicles. It would also be possible to couple plural cameras, and plural lighting devices, either with the single lifting mechanisms 27, 27' shown in the figures, or with each of a plurality of lifting mechanisms in the event that the service vehicle is fitted with plural container-engaging structures.

The cameras 46, and the lighting devices 48, if used, will necessarily be subject to the elements, and will also be subject to impact damage. This is particularly so for forward mounted components, such as those mounted at 47' in FIGS. 6A and 6B. For this reason, steps can be taken to protect the cameras 46 and lighting devices 48 used from such elements. For example, enclosures can be used to house such components. The housings can be provided with shutters for selectively exposing such components to the elements, or washing devices for cleaning such elements, if desired.

The camera 46, and the lighting device 48, if used, are coupled with a power source 49 for operating each unit and a processor 50. The processor 50 is preferably implemented with a heavy duty data processing unit located in the cab of the service vehicle (primarily for reasons of robustness). A solid state disk unit can be used to minimize the potentially adverse affects of vibration, if desired. The power source 49 can be kept separate from the service vehicle, if desired, but is preferably coupled with and derived from the electrical system of the service vehicle (i.e., a 12 volt, DC battery system). A regulator 51 preferably interfaces the auditing system 45 with the vehicle's electrical system for purposes of power regulation, isolation and surge protection.

The camera 46, and the lighting device 48, if used, are further coupled with the processor 50 for purposes of control and data management. This can include control functions such as auto-focus and iris adjustments for the camera 46 (shown at 52), and operation (including timed strobing) of the lighting device 48 (shown at 53). This will also include the communication of video signals acquired by the camera 46 to the processor 50 (shown at 54), preferably in conjunction with a "time stamp" indicating the time and date of the transaction. The processor 50 is also preferably coupled (at 55) with the service vehicle's systems for operating the lifting mechanism 27, 27' so the acquisition of data by the auditing system 45 can be initiated responsive to appropriate positioning of the lifting mechanism 27, 27', and the engaged container 1, 35, and correlated with operations of the lifting mechanism 27, 27'. Such operations are preferably performed automatically, without requiring any operator intervention.

As an example, to provide predictable positioning of the container relative to the camera 46 (to ensure an effective reading of the markings), the acquisition of video signals by a camera 46 positioned at 47 in FIGS. 5A and 5B can be performed as the container 1 is being raised to the position 31. Video signals can similarly be acquired by the camera 46 positioned at 47' in FIGS. 6A and 6B as the container 35 is lifted, or upon initial activation of the lifting mechanism 27'.

Figure 9:
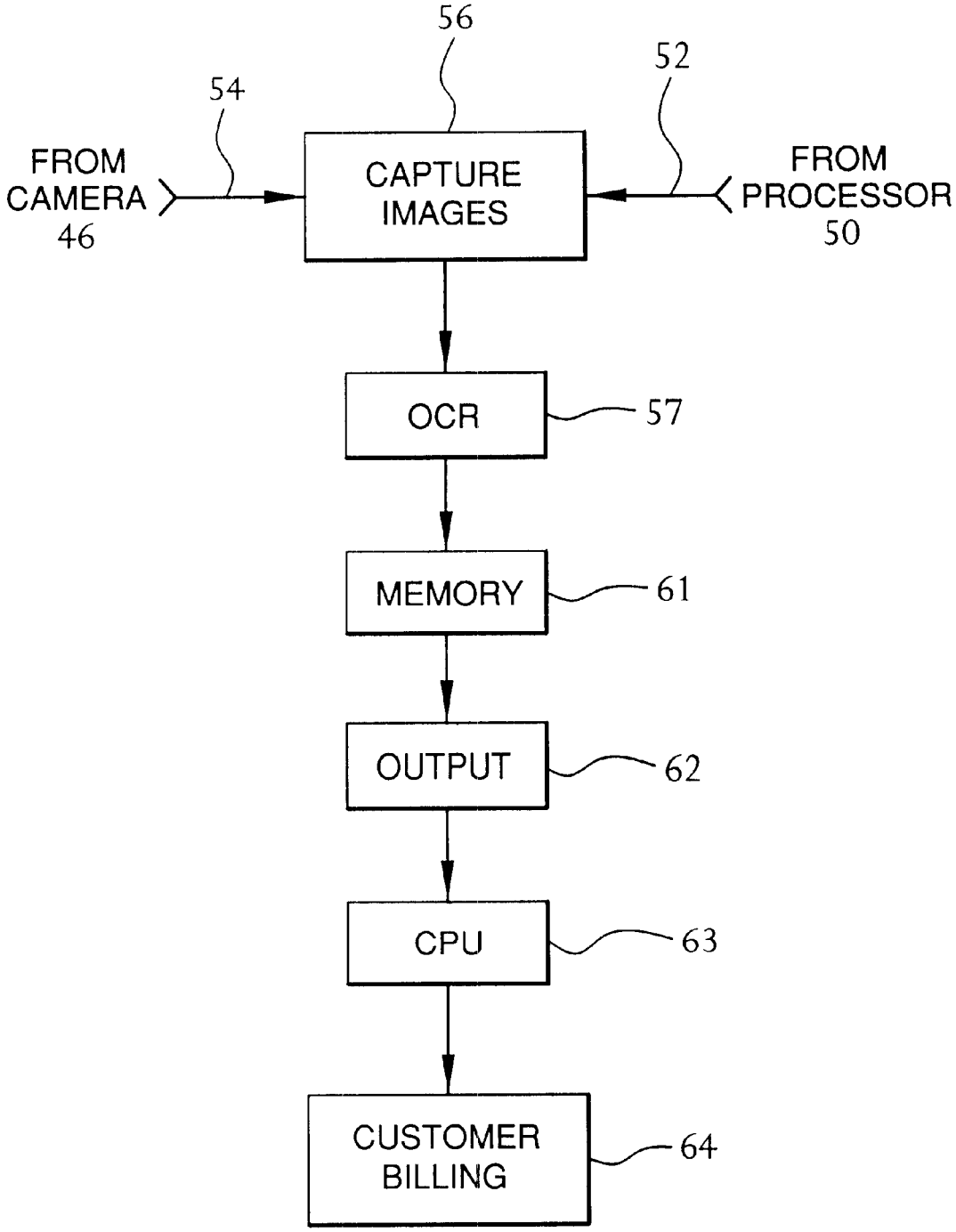
FIG. 9 is a flow chart which illustrates the overall auditing process of the present invention.

Referring to FIG. 9, following capture (at 56), the acquired video signals can then be subjected to optical character recognition techniques (at 57), which are themselves known, for purposes of interpreting the acquired images to determine the content of the markings provided on the container 1 (or on the container 35) being addressed (i.e., "read") by the auditing system 45. In conjunction with the address information previously referred to, this would include the interpretation of numerical and alphabetical characters corresponding to the subscriber's address.

For this, it is presently considered sufficient to employ character strings including up to 30 characters so that, for purposes of tracking an assumed number of subscribers (e.g., on the order of 2,000 subscribers), a relatively conservative amount of memory will be required to accommodate a normal (e.g., daily) servicing route. As an example, FIG. 8 illustrates the use of two rows of characters, with a top row 58*a* including up to 10 characters and a bottom row 58*b* including up to 20 characters, which should be sufficient for purposes of identifying a subscriber's address (e.g., a first row giving the street number and a second row giving the street name). Characters of a size on the order of one inch in width and two inches in height should provide sufficient readability. Also shown is the fiducial marking 59 (the "+" sign) which can be provided to further assist in the recognition of such markings.

Such functionality can be obtained using, for example, the "Sentry 9000" integrated inspection system which is available from AccuSentry of Marietta, Georgia, or an optical character recognition system based on the "HawkEye 1300" smart camera which is available from Computer Recognition Systems of Cambridge, Mass. An equivalent system would also be available from NeuriCam S.p.A., of Trento, Italy. Using such systems, the markings 44 on the containers can be read "on the fly", either as the service vehicle approaches the container or as the container is being operated upon by the lifting mechanism 27, 27', or when stationary, such as when the container is addressed by the service vehicle. Such systems will require only on the order of 250 mS to read the 30 character strings mentioned previously, and one or two seconds for complete identification data capture, including reading, processing and storage.

The foregoing components will preferably operate independent of the operator of the service vehicle so that the auditing process is performed automatically and without requiring any operator intervention. However, in such cases, the auditing system 45 will preferably provide a signal 60 (e.g., an alarm or a warning light) to inform the operator of instances where the auditing system 45 has not been able to either identify the subscriber (e.g., unable to read the address information on the container, or a container with address information which does not face forward) or to record the service provided (e.g., a missed count or weight measurement). The operator can then take the appropriate corrective measures (e.g., take a renewed reading, perform a manual reading, enter the information manually, etc.). In cases where the operator is to be included in the auditing process, the auditing system 45 can be provided with a display (e.g., positioned in the cab of the service vehicle) for monitoring the operations taking place, either having a touch screen capability or which is coupled with a separate keyboard.

The deciphered markings are then stored in memory, at 61, together with data indicating the service provided, for subsequent retrieval and processing as will be discussed more fully below. The data for indicating the service provided can be a simple count, indicating that a given container has been accessed, a count of the number of times that a given subscriber's container (or containers) has been accessed, an indication of the time and/or date of access, an indication of the weight of the contents which have been removed (e.g., employing known strain gauge scaling devices mated with the vehicle's lifting mechanism 27, 27'), or a combination of such parameters.

The stored data (memory 61) is then capable of being appropriately accessed (output 62), for download and transfer to a central processing unit 63. This can be accomplished using a cabled connection or any of a number of portable memory devices, at a central facility, or using a wireless connection either while the service vehicle proceeds along its established route or upon return to the central facility.

As examples, portable storage media such as a "Zip" disk (available from Iomega Corporation) could be used to transfer data from the processor 50 to the central processing unit 63. A conventional parallel interface can be used for this, or an SCSI interface could be used to achieve a higher transfer rate. As an alternative, a laptop computer could be used to extract the data from the processor 50, for example, through a fiber optic or infrared coupling (output 62). This, however, would in each case require the media which is used to be physically carried from the service vehicle to the central processing unit 63 at the service facility.

For this reason, a wireless solution is presently considered preferred. Such a solution can be implemented, for example, using equipment available from Proxim Company. To this end, a "RangeLAN2 7929/21" Series Ethernet Adapter, which provides wireless LAN connectivity with an Ethernet interface, and a "Harmony" PCI card for automatically forwarding packets of data, could be used as transmitting devices for installation on each of the service vehicles. A "RangeLAN2" Ethernet and Token Ring Access Point could then serve as a receiver for installation at the central facility (or central facilities). As an alternative, the foregoing could be accomplished via the Internet (using known Internet interface cards).

In operation, character strings corresponding to the subscriber's address (obtained, as previously described, using OCR techniques) and an indication of the service (or services) performed will be automatically collected and stored in memory, at 61, and immediately transferred to the central processing unit 63 once the wireless connection has been established. This can advantageously be accomplished following detection that a service vehicle has come within the range of the central processing unit 63 (at the central facility).

A system capable of reliably transferring data in a range of up to 1,000 feet should be sufficient for most applications. Multiple transfer points could also be employed, if appropriate for a particular installation. For systems capable of accommodating the previously described character strings, such a wireless solution will be capable of establishing synchronization and transfer of the collected data in an interval on the order of 10 seconds. For systems using an Internet connection, a data transfer rate on the order of about 120 Mbps should provide an adequate result, which would then be capable of establishing synchronization and transfer of the collected data in an interval on the order of 22 seconds. A serial port approach would be less expensive, but the transmission would take on the order of 10 minutes. Utilizing a parallel interface would require about 5 minutes. Consequently, neither of these latter approaches would presently support a dynamic transfer of data from the service vehicles.

In some applications, a service vehicle may enter more than one data access point. In such case, and to prevent the possibility of duplication, it is preferable to automatically purge data downloaded from memory 61 following transfer to the central processing unit 63, and every data transfer will preferably include a time tag.

The resulting data can then be processed (at 64) to produce customer billing which reflects a given subscriber's use of the refuse collection service (e.g., according to the number of times the subscriber's container has been emptied, the weight of the contents removed, or a combination of these parameters). The subscriber's billing can in this way reflect the actual cost of the services performed.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for auditing a refuse collection process performed by a service vehicle for emptying contents from a refuse container into a hopper associated with the service vehicle, for receiving the contents in the hopper, the apparatus comprising:

signaling means coupled with the container and changeable from a first state signaling that refuse collection is not to be performed to a second state signaling that refuse collection is to be performed, for signaling that the contents of the container are to be accessed; and identifying means coupled with the service vehicle, for automatically identifying containers having the signaling means in the second state, to indicate that the contents of the identified containers are to be emptied into the receiving hopper of the service vehicle, and for automatically identifying the refuse collection process performed on each of the identified containers.

2. The apparatus of claim 1 wherein the signaling means is a signal apparatus coupled with the container for movement between a first position signaling that the refuse collection is not to be performed and a second position signaling that the refuse collection is to be performed.

3. The apparatus of claim 2 wherein the container includes a body for receiving the contents through an opening formed in the container, a cover for enclosing the opening in the body of the container, and a hinged connection for joining the body and the cover so that the cover can rotate relative to the body, and wherein the signal apparatus includes:

an attachment assembly coupled with the hinged connection of the container, for engaging portions of the hinged connection so that the attachment assembly can rotate relative to the hinged connection and so that the signaling apparatus can rotate about the hinged connection and relative to the body and the cover;

a flag extending from the attachment assembly and having a configuration capable of extending over the cover; and a stop extending from the attachment assembly and having a configuration capable of engaging the body of the container.

4. The apparatus of claim 3 wherein the flag and the stop are rotatable relative to the cover and the hinged connection, between a lowered position in which the flag is positioned over the cover and the stop is spaced from the body of the container, and a raised position in which the flag is placed in a generally vertical orientation and the stop is in contact with the body of the container.

5. The apparatus of claim 3 wherein the attachment assembly includes a first band section having a first curved portion and a second band section having a second curved portion, and wherein the first band section is combined with the second band section so that the first curved portion opposes the second curved portion.

6. The apparatus of claim 5 wherein the first band section has a first mounting bracket coupled with an end of the first curved portion, and wherein the second band section has a second mounting bracket coupled with an end of the second curved portion.

7. The apparatus of claim 6 which further includes attachment means for connecting the first mounting bracket and the second mounting bracket, to combine and form the attachment assembly.

8. The apparatus of claim 6 wherein the flag extends from the first band section and wherein the stop extends from the second band section.

9. The apparatus of claim 8 wherein the flag and the stop extend from opposing sides of the attachment assembly.

10. The apparatus of claim 1 wherein the means for automatically identifying the containers having the signaling means in the second state includes means for identifying a corresponding subscriber to the refuse collection process.

11. The apparatus of claim 10 which further includes alphanumeric markings applied to the container which are unique to the subscriber.

12. The apparatus of claim 11 wherein the alphanumeric markings applied to the container include an upper row of up to ten characters and a lower row of up to twenty characters.

13. The apparatus of claim 11 which further includes optical character recognition means for identifying the alphanumeric markings applied to the container.

14. The apparatus of claim 13 which further includes a fiducial marking applied to container.

15. The apparatus of claim 14 which further includes means for identifying the fiducial marking and for aligning the optical character recognition means responsive to positioning of the fiducial marking.

16. The apparatus of claim 11 which further includes a video signal receptor positioned for alignment with the containers, and a processor coupled with the receptor for receiving video signals from the receptor.

17. The apparatus of claim 16 wherein the receptor is a CCD camera.

18. The apparatus of claim 16 which further include a light coupled with the receptor, for illuminating the markings applied to the container.

19. The apparatus of claim 18 wherein the light is a strobe light.

20. The apparatus of claim 18 wherein the light is an infrared light.

21. The apparatus of claim 16 wherein the containers include a contrasting background for receiving the markings, for distinguishing the markings applied to the container.

22. The apparatus of claim 16 wherein the processor is coupled with the service vehicle, for coordinating operations of the processor with operations of the service vehicle.

23. The apparatus of claim 22 wherein the processor is coupled with a container lifting mechanism associated with the service vehicle, for correlating operations of the processor with operations of the lifting mechanism.

24. The apparatus of claim 10 which further includes a coded label applied to the container which is unique to the subscriber.

25. The apparatus of claim 24 which further includes means for reading the coded label applied to the container.

26. The apparatus of claim 25 wherein the means for reading the coded label applied to the container is a bar code reader.

27. The apparatus of claim 10 which further includes means coupled with the container, for wireless transmission of a signal which is unique to the subscriber.

28. The apparatus of claim 27 wherein the wireless transmission means is an RF transmitter.

29. The apparatus of claim 1 wherein the means for automatically identifying the refuse collection process performed on each of the identified containers includes means for counting a number of times that the containers have been accessed.

30. The apparatus claim 1 wherein the means for automatically identifying the refuse collection process performed on each of the identified containers includes means for measuring an amount of the refuse removed from the containers, by weight.

31. The apparatus of claim 1 which further includes means for detecting an unsuccessful identifying of the container and the refuse collection process performed on the container, and an alarm coupled with the detecting means for signaling detection of the unsuccessful identifying.

32. The apparatus of claim 1 which further includes memory for storing data corresponding to the identified containers and the refuse collection process performed.

33. The apparatus of claim 32 which further includes a time stamp applied to the stored data.

34. The apparatus of claim 32 which further includes means for transferring the stored data to a processing unit remote from the service vehicle.

35. The apparatus of claim 34 wherein the transferring means is a wireless transmitter.

36. The apparatus of claim 34 wherein the transferring means is a portable memory device.

37. A method for auditing a refuse collection process performed by a service vehicle for emptying contents from a refuse container into a hopper associated with the service vehicle, for receiving the contents in the hopper, wherein the method comprises the steps of:

changing an apparatus coupled with the container from a first state signaling that refuse collection is not to be performed to a second state signaling that refuse collection is to he performed, signaling that the contents of the container are to be accessed;

servicing containers having a signaling apparatus in the second state, using the service vehicle, including emptying the contents of the serviced containers into the receiving hopper;

bypassing containers having a signaling apparatus in the first state; and automatically identifying each of the serviced containers, and the refuse collection process performed on each of the serviced containers.

38. The method of claim 37 wherein the changing of the apparatus from the first state to the second state includes the step of moving a signaling apparatus coupled with the container from a first position signaling that the refuse collection is not to be performed to a second position signaling that the refuse collection is to be performed.

39. The method of claim 38 wherein the first state corresponds to a lowered orientation for the signaling device and wherein the second state corresponds to a raised orientation for the signaling device.

40. The method of claim 37 wherein the step of automatically identifying each of the serviced containers includes the step of identifying a corresponding subscriber to the refuse collection process.

41. The method of claim 40 which further includes the step of identifying alphanumeric markings unique to the subscriber.

42. The method of claim 41 wherein the step of identifying the alphanumeric markings includes optical character recognition of the alphanumeric markings.

43. The method of claim 42 wherein the step of identifying the alphanumeric markings further includes the steps of identifying a fiducial marking, and aligning the optical character recognition responsive to the identifying of the fiducial marking.

44. The method of claim 40 which further includes the step of identifying a code unique to the subscriber.

45. The method of claim 44 wherein the step of identifying the code includes the step of reading a bar code.

46. The method of claim 44 wherein the step of identifying the code includes the step of receiving a wireless transmission of the code.

47. The method of claim 40 wherein the step of automatically identifying the serviced containers is coordinated with operations of the service vehicle.

48. The method of claim 37 wherein the step of automatically identifying the refuse collection process performed on each of the serviced containers includes the step of counting a number of times that the containers have been accessed.

49. The method of claim 37 wherein the step of automatically identifying the refuse collection process performed on each of the serviced containers includes the step of measuring an amount of the refuse removed from the containers, by weight.

50. The method of claim 37 which further includes the steps of detecting an unsuccessful identification of the serviced container and the refuse collection process performed on the serviced container, and providing an alarm signal responsive to the detection of an unsuccessful identification.

51. The method of claim 37 which further includes the step of storing data corresponding to the identified containers and the refuse collection process performed.

52. The method of claim 51 which further includes the step of recording a time stamp in combination with the storing of the data.

53. The method of claim 51 which further includes the step of transferring the stored data to a processing unit remote from the service vehicle.

54. The method of claim 53 wherein the transfer of the stored data includes a wireless transmission of the data from the service vehicle to the remote processing unit.

55. The method of claim 37 wherein the containers are correlated with a subscriber to the refuse collection process, and wherein the method further includes the step of charging the subscriber according to the refuse collection process which has been performed.

56. The method of claim 55 wherein the subscribers are charged responsive to a number of times that the containers have been accessed.

57. The method of claim 56 wherein the subscribers are charged responsive to a determined weight of the contents removed from the containers.

* * * * *